US007714219B2

(12) United States Patent
Taninbaum

(10) Patent No.: US 7,714,219 B2
(45) Date of Patent: May 11, 2010

(54) ENHANCED COMFORT HEADLESS TAMBOURINE

(75) Inventor: Richard L. Taninbaum, Mamaroneck, NY (US)

(73) Assignee: Rhythm Tech, Inc., New Rochelle, NY (US)

( * ) Notice: Subject to any disclaimer, the term of this patent is extended or adjusted under 35 U.S.C. 154(b) by 0 days.

(21) Appl. No.: 11/685,042

(22) Filed: Mar. 12, 2007

(65) Prior Publication Data

US 2007/0234874 A1 Oct. 11, 2007

Related U.S. Application Data

(60) Provisional application No. 60/781,466, filed on Mar. 10, 2006.

(51) Int. Cl.
*G10D 13/02* (2006.01)

(52) U.S. Cl. ..... 84/418; 84/411 R

(58) Field of Classification Search ..... 84/102–104, 84/402–404, 406, 411, 418, 420
See application file for complete search history.

(56) References Cited

U.S. PATENT DOCUMENTS 3,635,120 A * 1/1972 Koishikawa ..... 84/418
4,230,015 A * 10/1980 Taninbaum ..... 84/418
4,346,637 A * 8/1982 Janszen ..... 84/418
5,040,446 A * 8/1991 Cohen et al. ..... 84/418
D354,301 S * 1/1995 Sahlev ..... D17/22
5,377,575 A * 1/1995 Huth, III ..... 84/402
5,509,343 A * 4/1996 Hsu ..... 84/418
5,567,898 A * 10/1996 Shalev ..... 84/418
6,127,614 A * 10/2000 Lombardi ..... 84/418
D436,367 S * 1/2001 Shalev ..... D17/22
D446,238 S * 8/2001 Grey ..... D17/22

* cited by examiner

*Primary Examiner*—Jeffrey Donels
*Assistant Examiner*—Christopher Uhlir
(74) *Attorney, Agent, or Firm*—Lackenbach Siegel, LLP; Myron Greenspan

(57) ABSTRACT

An improved tambourine has a rigid, enclosed, jingle-supporting frame that defines a center of gravity and a number of pairs of percussion jingles connected to the frame at determined locations around one of the frame's segments. A handle for manually grasping the frame is connected to a second segment of the frame. The second segment is closer to the center of gravity of the tambourine than is the first segment, which is arcuate in shape. The second segment includes radial, inwardly turned portions and a handle-bearing portion that is substantially parallel to a chord formed between the ends of the arcuate first segment and spaced a determined distance from the geometric center of the handle.

6 Claims, 5 Drawing Sheets

FIG. 10
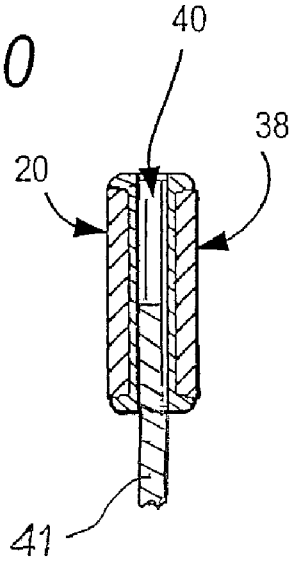
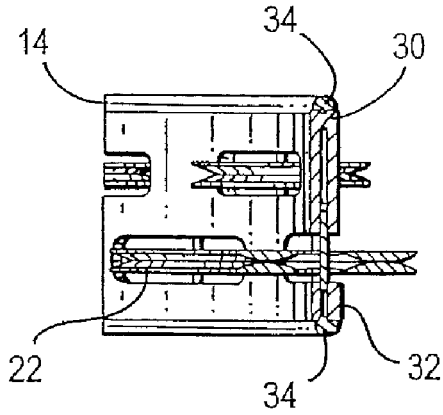
FIG. 11
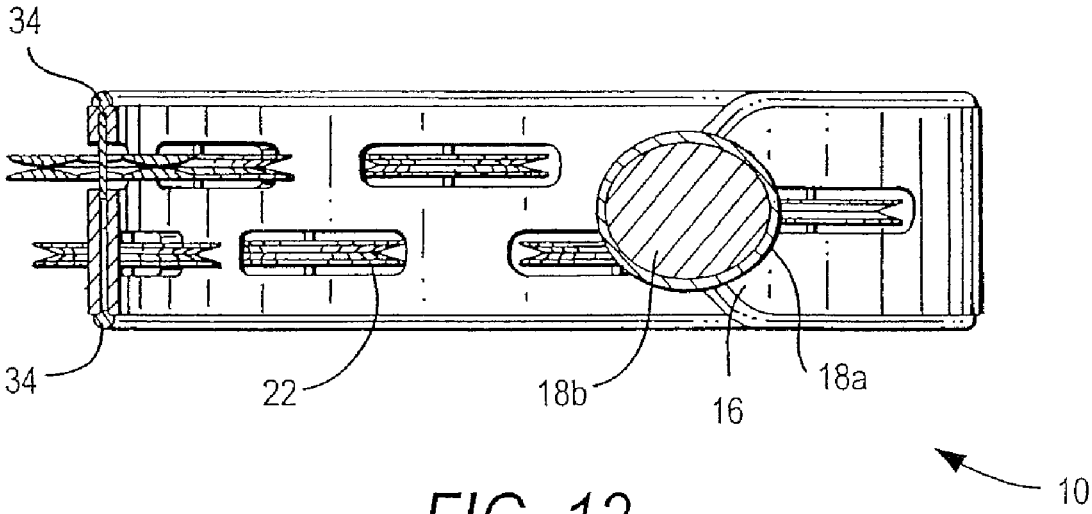
FIG. 12

ENHANCED COMFORT HEADLESS TAMBOURINE

CROSS-REFERENCE TO OTHER APPLICATIONS

This application is based on and claims priority of Provisional Patent Application Ser. No. 60/781,466 filed on Mar. 10, 2006.

BACKGROUND OF THE INVENTION

1. Field of the Invention

The invention relates to musical percussion instruments and, more specifically, to an improved tambourine.

2. Description of the Prior Art

This invention generally relates to a "headless" tambourine, which is a percussion musical instrument used in contemporary rock music. Conventional tambourines are circular in shape and include sounding elements that essentially jingle mounted in slots circumferentially spaced around the circular frame.

One drawback of conventional tambourines is that the hand and arm can become tired because the instrument is typically grasped at one edge of the circular frame. Thus, a large moment of force is created by holding the frame on an edge, which causes discomfort to the user. Grasping of the instrument can also be awkward because of the shape of the frame in relation to the position of the grasping hand.

In U.S. Pat. No. 4,230,015, issued to the inventor of the subject application, a tambourine is disclosed that includes a frame having a grasping portion disposed at or near the center of gravity of the rim such that the tambourine may be comfortably held for long periods of time. The handle can be disposed near the geometrical center of the rim. However, the teaching that the handle be disposed at or near the center of gravity of the rim can present a disadvantage. By totally or substantially eliminating the distance between the geometrical center of the handle and the center of gravity, the user may have the perception is that there is virtually no moment because the virtual pivot point may coincide with the geometrical center of the handle. Without the feel of a moment force, there can be some loss of the "feel" of a tambourine and a loss of control, as a user may anticipate, that such moment force does or will exist during use.

SUMMARY OF THE INVENTION

Accordingly, it is an object of the invention to provide an improved tambourine that is easier and more convenient to use.

It is another object of the invention to provide a tambourine that allows for improved handling characteristics for greater dexterity while not diminishing the tonal characteristics of the musical instrument.

It is still another object of the invention to provide an improved tambourine that requires less muscular strength, thereby reducing fatigue for its operation and actuation.

It is yet another object of the invention to provide an improved tambourine that reduces fatigue while providing a reduced moment force at a virtual pivot point spaced from the center of the handle.

It is a further object of the invention to provide an improved tambourine that enhances the level of comfort to the user during use while enhancing control over the tambourine's movements.

It is still a further object of the invention to provide an improved tambourine that is formed of a generally rigid frame but provided with a softer, rubber-like material covering the edges of the frame and the handle to prevent damage to the frame and improve the feel of the tambourine.

It is yet a further object of the invention to provide at least one through hole or aperture on the frame of the tambourine suitable for receiving an accessory for use with a tambourine.

In order to achieve the above objects and other that will become evident to those skilled in the art, an improved tambourine in accordance with the invention comprises a rigid, enclosed, jingle-supporting frame defining a center gravity.

In view of the teachings in the earlier patent, as well as the benefits to be derived by providing a feel of a moment about a virtual pivot point, a compromise can be made between these two parameters that optimizes control over the tambourine as well as minimizes or diminishes the discomfort and fatigue during extended use. The present invention overcomes the drawback found in the prior art and in the earlier patent without diminishing the acoustical qualities of the device by providing a tambourine that includes a handle having a geometrical center that is spaced a predetermined distance from the center of gravity of the tambourine frame. Such spacing is selected to be within the range of 15-35% of the maximum radial dimension from the geometrical center of the frame.

Another feature includes an overmolding of a rubberized material over the handle as well as the edges of the frame. The rubberized material is softer than the generally rigid material from which the frame is made. Also, through apertures or holes are provided at the inflection points where the larger outer segment of the frame meets the small, inner segment that supports the handle. The through openings or holes are configured and dimensioned to selectively receive accessories for use with the tambourine, such as rod-like portions or pins of a support or stand, or scarves, ribbons, streamers or other decorative items that can flutter, flap or the like, while the tambourine is moved about.

BRIEF DESCRIPTION OF THE DRAWINGS

Various further objects, features and attendant advantages of the present invention will be fully appreciated as the invention is better understood in light of the accompanying figures, in which like reference numbers or characters designate the same or similar parts within the figures, and wherein:

FIG. 10 is a cross-sectional view of the tambourine according to the invention taken along line B-B in FIG. 1;

FIG. 11 is a cross-sectional view of the tambourine according to the invention taken along the line C-C in FIG. 1;

FIG. 12 is a cross-sectional view of the tambourine according to the invention taken along the line D-D in FIG. 1.

DETAILED DESCRIPTION OF THE PREFERRED EMBODIMENTS

Figure 1:
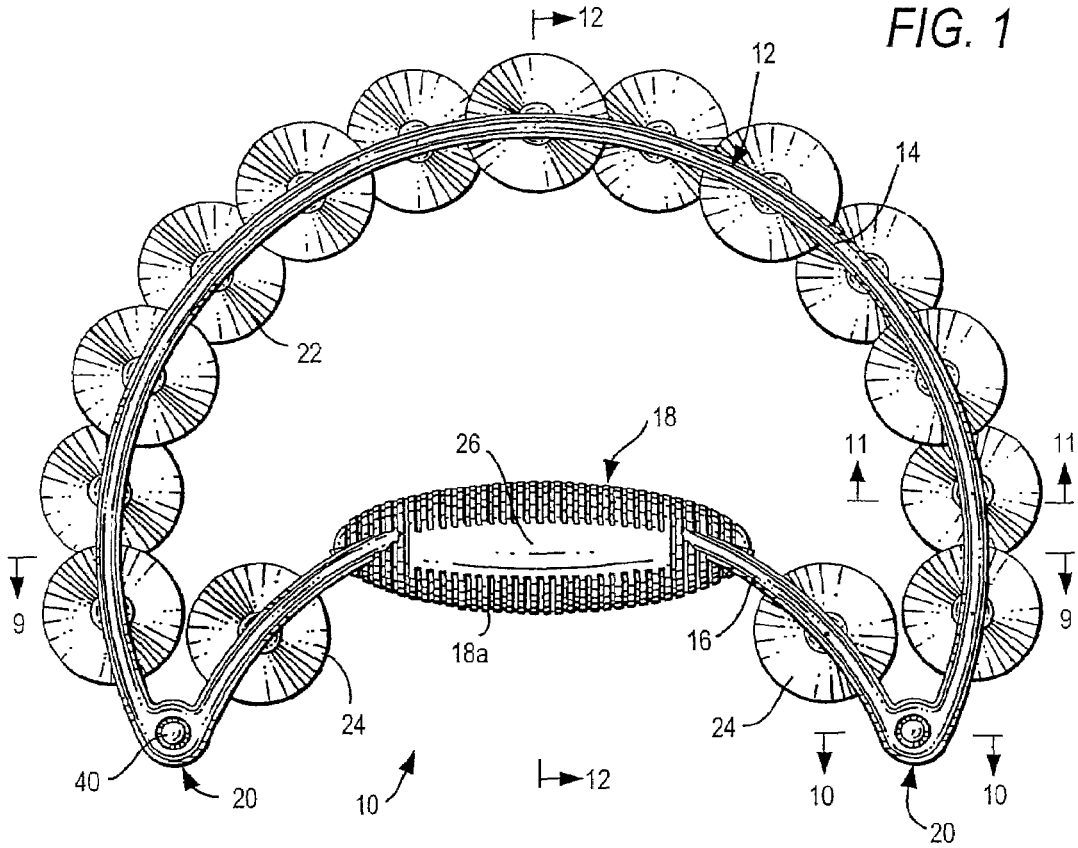
FIG. 1 is a top plan view of the improved tambourine according to the invention.
Figure 3:
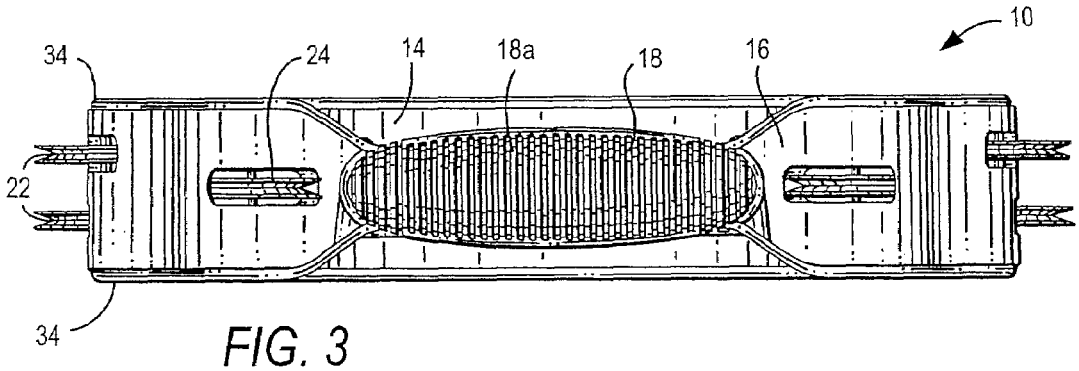
FIG. 3 is a rear elevational view of the tambourine according to the invention.
Figure 5:
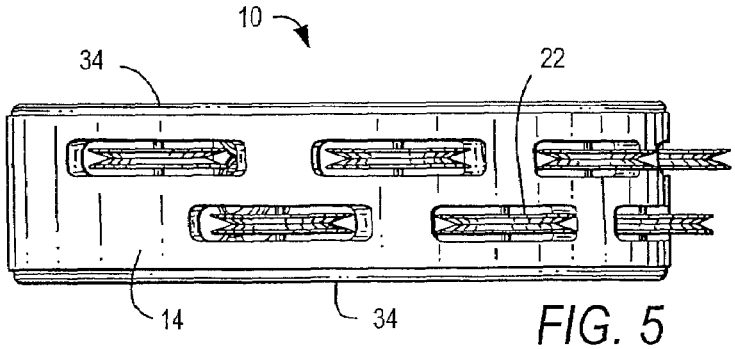
FIG. 5 is a right side elevational view of the tambourine according to the invention.
Figure 2:
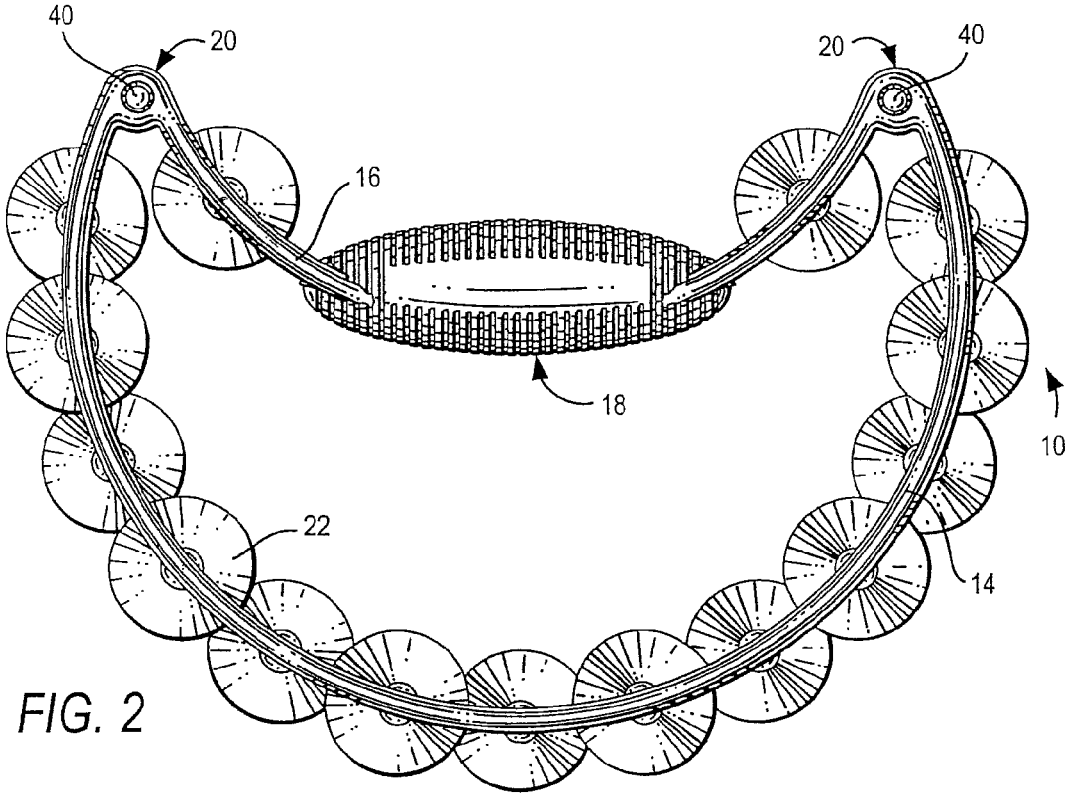
FIG. 2 is a bottom plan view of the tambourine according to the invention.
Figure 4:
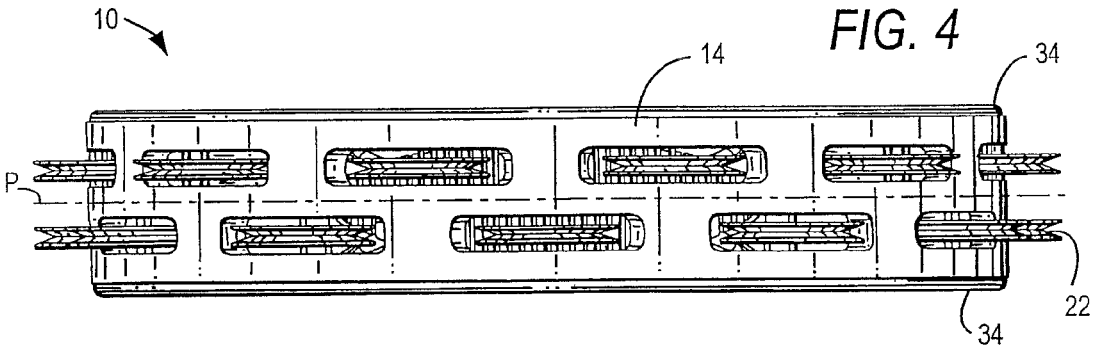
FIG. 4 is a front elevational view of the tambourine according to the invention.
Figure 6:
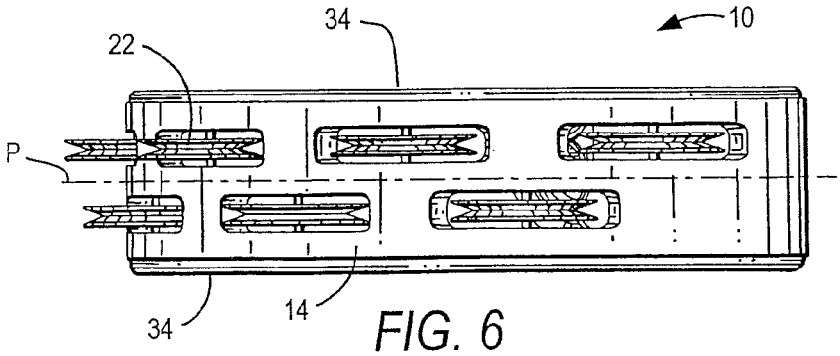
FIG. 6 is a left side elevational view of the tambourine according to the invention.
Figure 7:
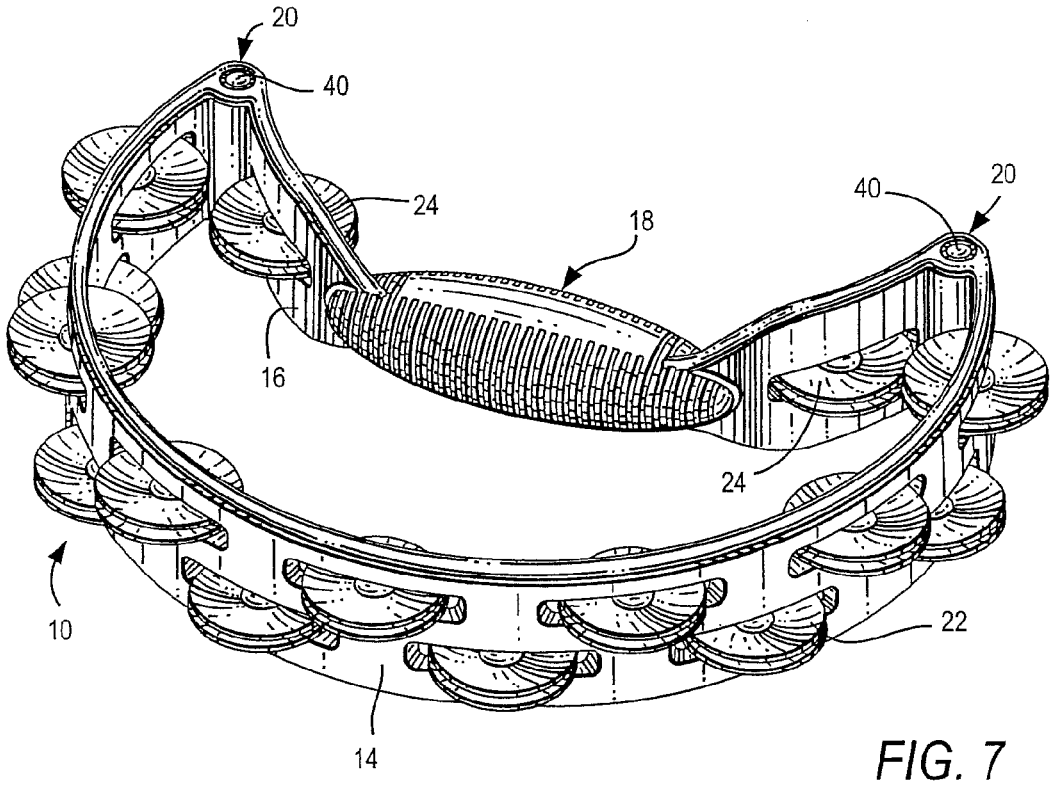
FIG. 7 is a front perspective view of the tambourine according to the invention.
Figure 8:
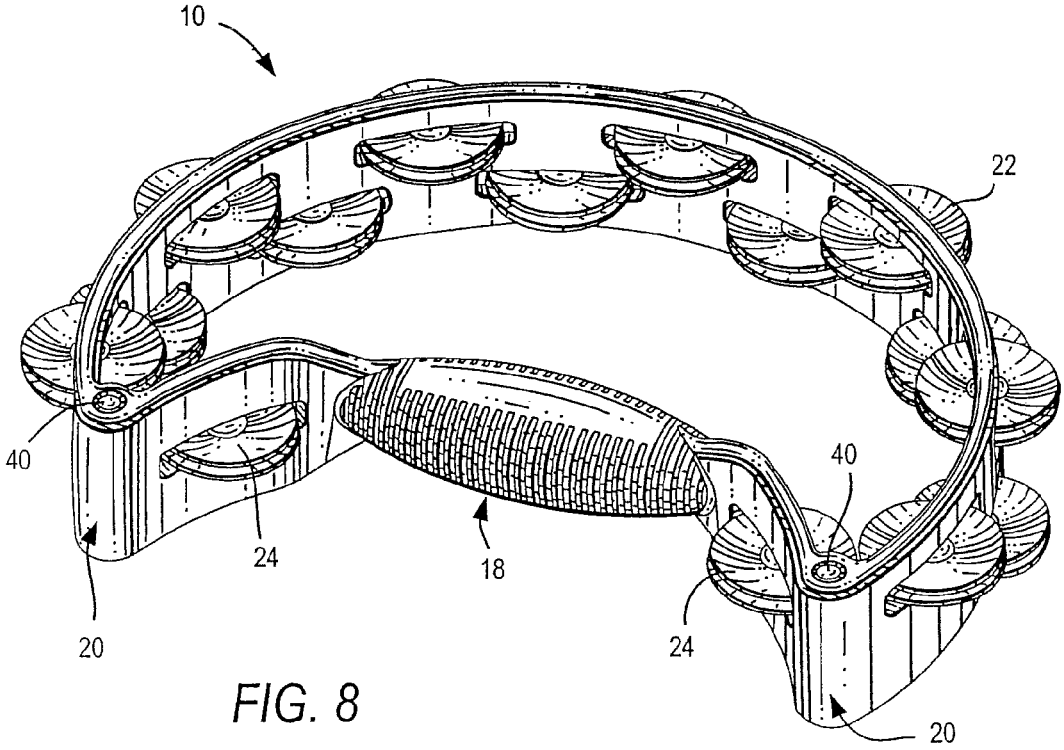
FIG. 8 is a rear perspective view of the tambourine according to the invention.

Referring now specifically to the Figures, in which similar or identical parts are designated by the same reference numerals throughout, and first referring to FIGS. 1-8, the improved tambourine in accordance with the invention is generally designated by the reference numeral 10. The tambourine 10 comprises a partially circular frame 12 including a larger, generally circular first segment 14 and a smaller, generally circular second segment 16. The smaller segment includes a handle 18 that allows the instrument to be comfortably grasped.

Figure 9:
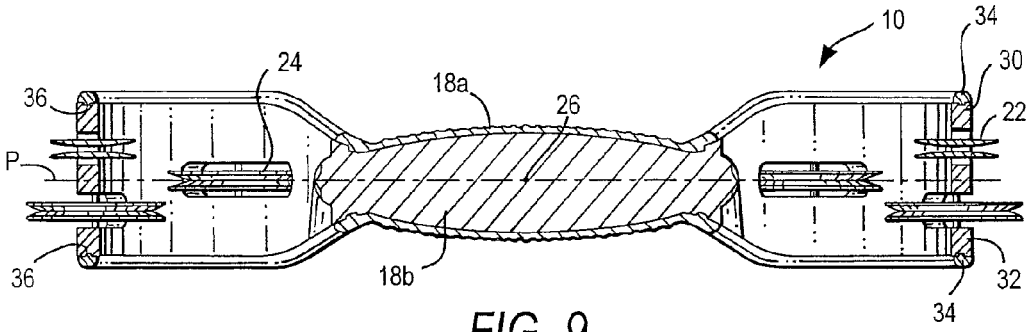
FIG. 9 is a cross-sectional view of the tambourine according to the invention taken along line A-A in FIG. 1.
Figure 13:
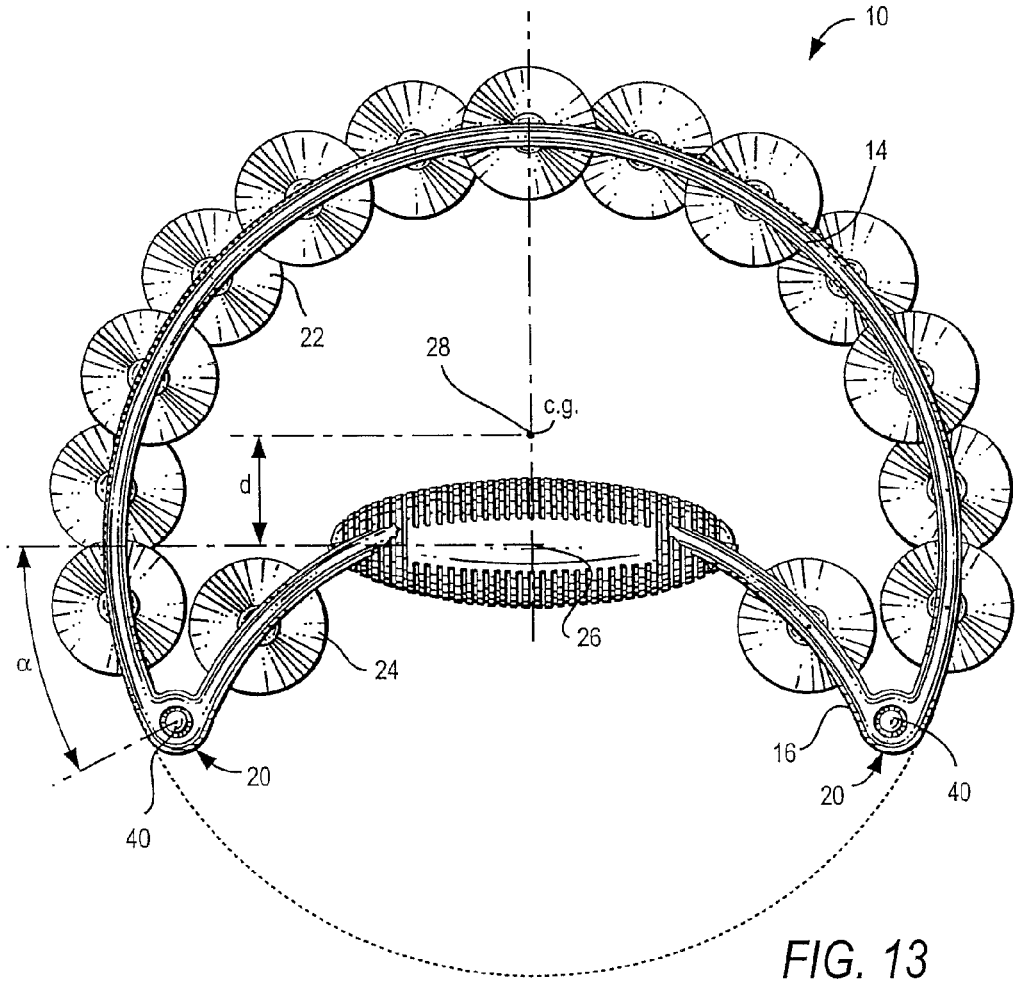
FIG. 13 is similar to FIG. 1 and shows dimensional relationships of the tambourine according to the invention.

The larger circular segment 14 and the smaller circular segment 16 of the partially circular frame 12 meet at inflection points 20 to each side of the handle 18 that may define an angle $\alpha$ of 20-35°, and shown as being approximately 27° in FIG. 13. A plurality of sounding elements, such as jingles 22, are in spaced relationship along the larger circular segment 14 of the frame 12 in a conventional manner. As shown, for example, in FIGS. 4 and 6, the individual jingles 22 are each formed of a pair of juxtaposed plates and staggered or circumferentially spaced from each other along the larger segment 14, and successive jingles are axially offset from each other to avoid contact. Optional jingles 24 can also be mounted on the shorter handle segment 16. Because of the shorter length of the handle segment 16, a single jingle pair is provided to each side of the handle 18. The jingles 24 can also be centered to generally coincide $\alpha$=27° with the plane P of the frame, as shown in FIG. 9.

In order to provide the user with a greater sense of control and "feel" of a tambourine, the center 26 of the handle 18 is preferably spaced from the center of gravity 28. The handle 18, in FIG. 13, is shown spaced a predetermined distance "d" beyond the center of gravity 28 of the tambourine 10. Clearly, the greater the distance d, the greater the turning or pivoting moment that the user experiences. However, the greater the moment the greater the fatigue over extended use. Thus, a compromise must be made between with the distance d that still provides the user with a desired degree of control and "feel" of a tambourine without significantly increasing the level of fatigue with extended use. It has been determined that the distance d should preferably be selected from within the range of 15-25% of the radius of the larger circular segment 14, or the largest radial distance from a geometrical center of the handle to the periphery of the outer segment 14.

The specific shape or material used for the handle 18 is not critical. However, the handle 18 is preferably covered with a rubber-like material that is softer than the rigid material forming the supporting frame members 14, 16. The handle 18 is shown to generally be in the shape of an ellipsoid that renders the handle comfortable to hold. Preferably, the exterior surface of the handle 18 is provided with ridges or ribs 18*a* (FIGS. 1 and 9). These ridges or ribs 18*a* substantially circumscribe the handle 18 and are spaced from each other along the axis of symmetry of the handle, shown to extend from side to side in FIG. 1. The softer or rubber-like material used for the handle can be co-molded over an internal handle core 18*b* (FIGS. 9 and 12) that may be made of a harder or more rigid material and may be integrally formed with the smaller handle segment 16 and of the same material.

Advantageously, the over-molded rubber-like material covering the handle 18 can also be used to over-mold the opposing edges 30, 32 of the flat frame segments 12, 14 with a protective resilient strip 34. Referring to FIG. 11, for example, the opposing edges of the frame segments may be provided with longitudinal or elongate grooves or channels 36 into which the rubber-like material 34 may be molded in order to increase or enhance the retaining forces and to resist separation of the rubber-like material after it has cured and hardened.

Similarly, the rubber-like material may also be deposited about the transition points 20. Here, the thickness of the rubber-like material, at 38 (FIG. 10) is greater than the thickness of the material deposited along the edges 30, 32 since the transition points 20 may be more likely to impact on rigid surfaces and the rubber-like material prevents the frame from being scratched, chipped or otherwise damaged.

A further feature of the invention is that the enlarged inflection points 20 are provided with through-holes 40 that define substantially parallel axes generally normal to the plane P defined by the supporting frame 12. The through-holes 40 are dimensioned to selectively receive an accessory for use with the tambourine. Thus, the holes 40 can be use to received pins or rods 41 (FIG. 10) that form part of a support for the tambourine. However, the through-holes 40 may also be used to pass various fabrics or other materials that flutter or flap when the tambourine is moved about. Such materials may be, for example, handkerchiefs, scarves, streamers, ribbons, tapes, or the like.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What is claimed:

1. An improved tambourine, comprising:

a rigid, enclosed jingle supporting frame defining a center of gravity;

a plurality of pairs of percussion jingles connected to said frame at predetermined locations about a first segment of said frame; and a handle for manually grasping said frame, connected to a second segment of said frame, said second segment bearing said handle being disposed closer to the said center of gravity of the tambourine than said first segment, said first segment of said frame being arcuate in shape, and said second segment including radial, inwardly disposed portions and a handle bearing portion that is substantially parallel to a chord formed between the ends of said arcuate first segment, said handle having a geometric center spaced a predetermined distanced "d" beyond said center of gravity of the tambourine, said predetermined distance "d" being selected to be within the range of 15-35% of the maximum radial dimension from a geometric center of said supporting frame.

2. An improved tambourine according to claim 1, wherein said distance "d" is approximately 25%.

3. An improved tambourine, comprising:

a rigid, enclosed jingle supporting frame defining a center of gravity;

a plurality of pairs of percussion jingles connected to said frame at predetermined locations about a first segment of said frame; and a handle generally in the shape of an ellipsoid for manually grasping said frame, connected to a second segment of said frame, said second segment bearing said handle being disposed closer to the said center of gravity of said tambourine than said first segment, said first segment of said frame being arcuate in shape, and said second segment including radial, inwardly disposed portions and a handle bearing portion that is substantially parallel to a chord formed between the ends of said arcuate first segment, said first and second frame segments being generally flat and normal to a plane defined by said supporting frame and defining opposing edges and said handle having generally rounded cross-sections without opening edges, said opposing edges and substantially said entire handle being covered by a rubber-like material that is softer than the rigid material forming said supporting frame; wherein the handle has a center being 15-35% of a maximum radial dimension from a geometric center of the frame.

4. An improved tambourine according to claim 3, wherein said rubberlike material covering said handle is provided with a plurality of spaced grooves or recesses.

5. An improved tambourine according to claim 4, wherein said grooves or recesses are spaced from each other and each define a plane generally normal to the length direction of said handle.

6. An improved tambourine, comprising:

a rigid, enclosed jingle supporting frame defining a center of gravity;

a plurality of pairs of percussion jingles connected to said frame at predetermined locations about a first segment of said frame;

a handle for manually grasping said frame, connected to a second segment of said frame, said second segment bearing said handle being disposed closer to the said center of gravity of said tambourine than said first segment, said first segment of said frame being arcuate in shape, and said second segment including radial, inwardly disposed portions and a handle bearing portion that is substantially parallel to a chord formed between the ends of said arcuate first segment, wherein said first and second segments meet at inflection points formed with through-holes defining substantially parallel axes generally normal to a plane defined by said supporting frame, said through-holes being dimensioned to selectively receive an accessory for use with the tambourine; and an accessory for use with the tambourine that is selectively and at least partially received within at least one of said through holes said accessory being a handkerchief, a scarf, streamers, ribbons, or tape.

* * * * *